US012264001B2

(12) United States Patent
Busch

(10) Patent No.: US 12,264,001 B2
(45) Date of Patent: Apr. 1, 2025

(54) LOCKABLE AND STACKABLE CONTAINER WITH SECURE LID

(71) Applicant: Busch Systems International Inc., Barrie (CA)

(72) Inventor: Craig Busch, Barrie (CA)

(73) Assignee: BUSCH SYSTEMS INTERNATIONAL INC., Barrie (CA)

( * ) Notice: Subject to any disclaimer, the term of this patent is extended or adjusted under 35 U.S.C. 154(b) by 357 days.

(21) Appl. No.: 17/602,520

(22) PCT Filed: Apr. 9, 2020

(86) PCT No.: PCT/CA2020/050473

§ 371 (c)(1),
(2) Date: Oct. 8, 2021

(87) PCT Pub. No.: WO2020/206547

PCT Pub. Date: Oct. 15, 2020

(65) Prior Publication Data

US 2022/0161976 A1 May 26, 2022

Related U.S. Application Data

(60) Provisional application No. 62/832,008, filed on Apr. 10, 2019.

(51) Int. Cl.

| | |
|---|---|
| ***B65D 43/02*** | (2006.01) |
| ***B65D 1/22*** | (2006.01) |
| ***B65D 21/02*** | (2006.01) |
| ***B65D 25/28*** | (2006.01) |
| ***B65D 55/02*** | (2006.01) |

(52) U.S. Cl.
CPC ..... *B65D 55/02* (2013.01); *B65D 1/22* (2013.01); *B65D 21/0222* (2013.01);
(Continued)

(58) Field of Classification Search
CPC ..... B65F 1/1615; B65F 1/02; B65F 1/1468; B65F 1/141; B65F 1/16; B65F 1/1607;
(Continued)

(56) References Cited

U.S. PATENT DOCUMENTS 6,808,081 B1 * 10/2004 Citro ..... B65F 1/16 116/63 P
9,669,959 B2 * 6/2017 Luburic ..... B65D 1/16
(Continued)

FOREIGN PATENT DOCUMENTS

GB 2 243 868 A 11/1991
KR 101285178 B1 7/2013

OTHER PUBLICATIONS

European Search Report mailed Jul. 27, 2022 for European Patent Application No. 20787780.4 for Busch Systems International Inc., 12 pages.

(Continued)

*Primary Examiner* — King M Chu
(74) *Attorney, Agent, or Firm* — Cesari and McKenna, LLP

(57) ABSTRACT

A container with an opening for receiving items for later disposal is disclosed. The container includes a container body with a bottom and a sidewall extending upwards from the bottom, as well as a removable lid to close the container. The container also includes a lock to lock the lid to the container. An engagement structure is provided on a side opposite the lock to prevent separation of the lid from the container body. The container may be stackable by including complementary male and female structures on the bottom and the lid. The container may also include a handle adjacent the bottom that contacts the ground when the container rests on the ground.

16 Claims, 10 Drawing Sheets

(52) U.S. Cl.
CPC ..... *B65D 25/2885* (2013.01); *B65D 43/0225* (2013.01); *B65D 2543/00212* (2013.01); *B65D 2543/00351* (2013.01); *B65D 2543/00527* (2013.01); *B65D 2543/00537* (2013.01)

(58) Field of Classification Search
CPC ..... B65F 2220/12; B65F 2220/124; B65F 21/0219; B65F 2210/169; B65D 55/02; B65D 1/22; B65D 21/0222; B65D 25/2885; B65D 43/0225; B65D 2543/00212; B65D 2543/00351; B65D 2543/00527; B65D 2543/00537
USPC ..... 220/212.5, 788
See application file for complete search history.

(56) References Cited

U.S. PATENT DOCUMENTS

| | | | | |
|---|---|---|---|---|
| 11,542,095 | B2 * | 1/2023 | Altadonna, Jr. ... | B65D 43/0202 |
| 2003/0197013 | A1 | 10/2003 | Conti et al. | |
| 2008/0169288 | A1 | 7/2008 | Dawn | |
| 2009/0107998 | A1 | 4/2009 | Meissen | |
| 2013/0186897 | A1 | 7/2013 | Luburic | |
| 2014/0027454 | A1 * | 1/2014 | Banik ..... | B65F 1/1468 220/212.5 |
| 2015/0151910 | A1 * | 6/2015 | Banik ..... | B65F 1/1615 220/212.5 |
| 2015/0321796 | A1 * | 11/2015 | O'Leary ..... | B65D 3/06 220/675 |

OTHER PUBLICATIONS

International Search Report and Written Opinion mailed Jul. 23, 2020 for International Application No. PCT/CA2020/050473 filed Apr. 9, 2020 for Busch Systems International Inc., 11 pages.
European Search Report mailed Apr. 26, 2022 for European Patent Application No. 20787780.4 for Busch Systems International Inc., 13 pages.

* cited by examiner

LOCKABLE AND STACKABLE CONTAINER WITH SECURE LID

FIELD

The present disclosure relates generally to lockable containers and, in particular, to a lockable and stackable container for receiving and storing paper for later disposal, such as shredding.

BACKGROUND

Containers may be used to collect documents for later disposal, such as shredding. Such containers include an opening for receiving the documents. A lid or cover is provided that can be opened and possibly removed entirely, allowing the contents of the container to be emptied. The lid may be lockable to the container when the paper to be disposed of is to remain secure because it contains confidential information or other information of a sensitive nature.

BRIEF DESCRIPTION OF THE DRAWINGS

The following detailed description of illustrative embodiments of the present disclosure, will be better understood when read in conjunction with the appended drawings. For the purposes of illustrating the present disclosure, there is shown in the drawings illustrative embodiments of the disclosure. It should be understood, however, that the disclosure is not limited to the precise arrangements and instrumentalities shown. In the drawings.

DETAILED DESCRIPTION

Figure 1:
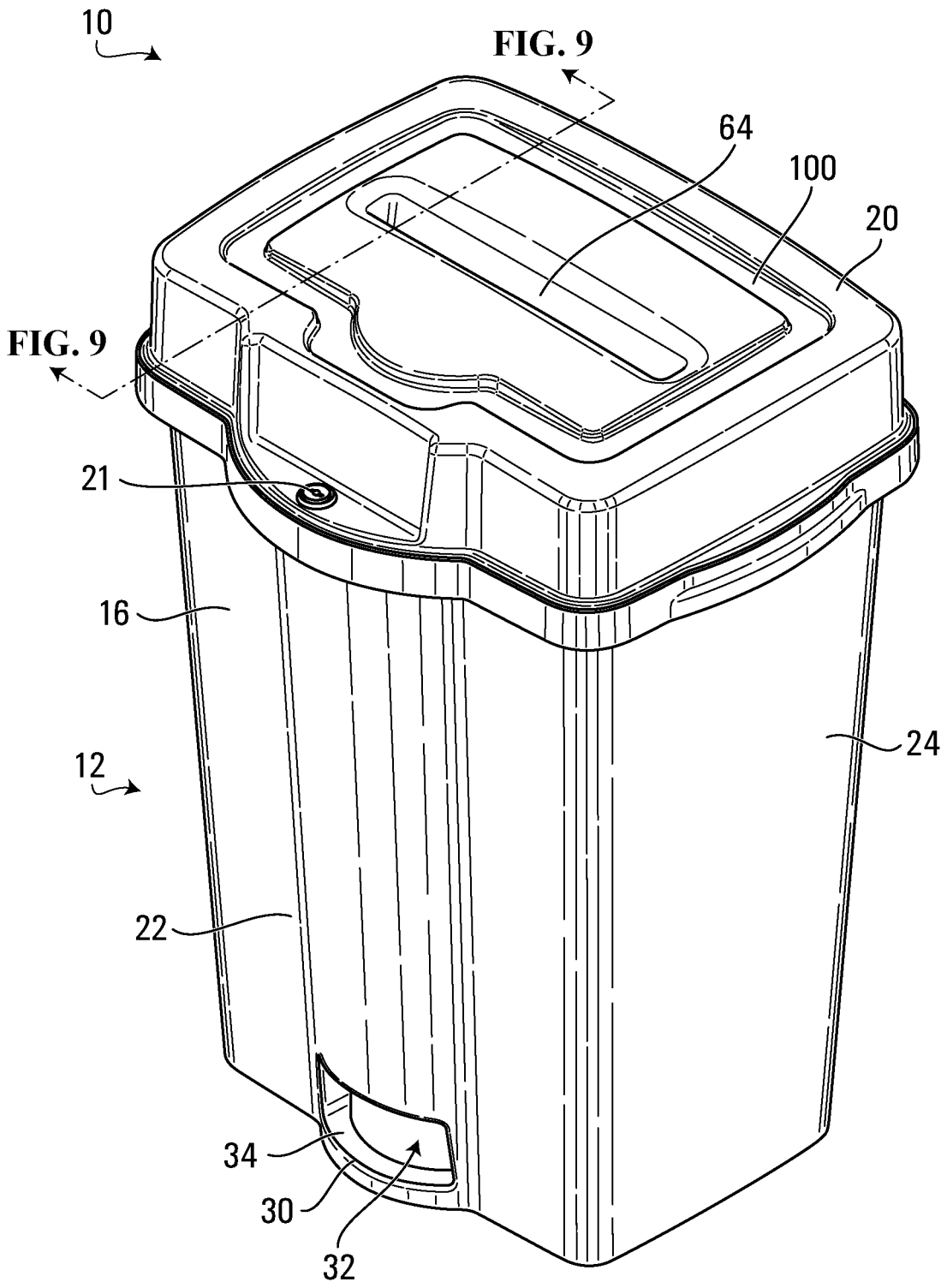
FIG. 1 is a top perspective view of a container according to one embodiment of the present disclosure.

Lockable receptacles to receive items for later disposal, such as paper for later shredding, may be used in a wide variety of environments. For example, containers to collect paper to be shredded may be placed near work stations, for example under or beside desks, or in an office or cubicle. Such containers may be made of plastic (thermoset or thermoplastic), which provides a desired weight to strength ratio and also permits moulding of the container. Moulding allows for the inclusion of aesthetic or functional features, such as security features, which might not be as easily included with other, non-mouldable materials where more manual labor may be needed.

In cases where the lid is locked to the container to keep the container's contents secure, the container remains locked until an individual authorized to empty the container and dispose of the contents unlocks it, for example with a key. In such cases, it may be desirable to have additional security features included in the container to prevent unauthorized access until the container is emptied.

Moreover, depending on the size and number of containers to be emptied, a user may collect multiple containers at once, for example from a row of offices or cluster of cubicles, and bring them to a central location for emptying. In such cases, it may be desirable to be able to securely stack the containers, for example three in a column, on a dolly or other means of transport for bringing the containers to the emptying location.

Embodiments of containers according to the present disclosure will now be described with references to the figures.

FIGS. 1 through 4 show a container 10 according to one embodiment of the present disclosure. The container 10 includes a container body 12 having a bottom 14 and a side wall 16 extending upwards from the bottom 14. The side wall 16 defines a container body opening 18, which is covered by a removable lid 20.

A lock 21 is provided for locking the lid 20 to the container body 12.

In the illustrated embodiment, the container body 12 is generally rectangular in cross-section with a front side 22, a right side 24, a left side 26 and a rear side 28. The container body 12 tapers towards the bottom, which allows the container body 12 to be nested with other, identical container bodies, for example during shipping.

However, in other embodiments, other shapes and cross-sections for the container body 12 are possible. For example, the body might not be tapered or may not be rectangular. An oval or circular cross-section might be possible.

The container body 12 includes a handle 30 arranged adjacent the bottom 14. The handle 30 is configured and arranged such that, when the container 10 rests on the ground, the handle 30 contacts the ground. In the illustrated embodiment, the entire underside of the handle 30 contacts the ground. However, in other embodiments only a portion of the handle may contact the ground.

A recess 32 is provided in a portion of the side wall 16 adjacent the bottom 14 and an aperture 34 opens the recess 32 to an underside of the container body 12. The handle 30 is defined by a bridge that spans the aperture 34 and recess 32. The handle 30 is curved laterally outwards from the side wall 16.

In other embodiments, the handle 30 might be omitted or might be configured differently. For example, the recess 32 and the aperture 34 may be absent and the handle would extend out from the side wall in a curved shape or another shape. Alternatively, the handle could extend straight across the recess and aperture rather than curving outward. The handle could also extend laterally outward from the side wall in another shape. In some embodiments, the handle may be positioned elsewhere on the container 10.

The handle has a surface 35 that may be stepped on by a user of the container 10 to aid in keeping the container 10 on the ground while lifting or removing the lid 20 or unlocking the container, as will be described below. The surface 35 may be flat to better permit a foot resting or stepping on the handle 30. The recess 32 may also be sized to accommodate a front part of a user's foot.

Figure 5:
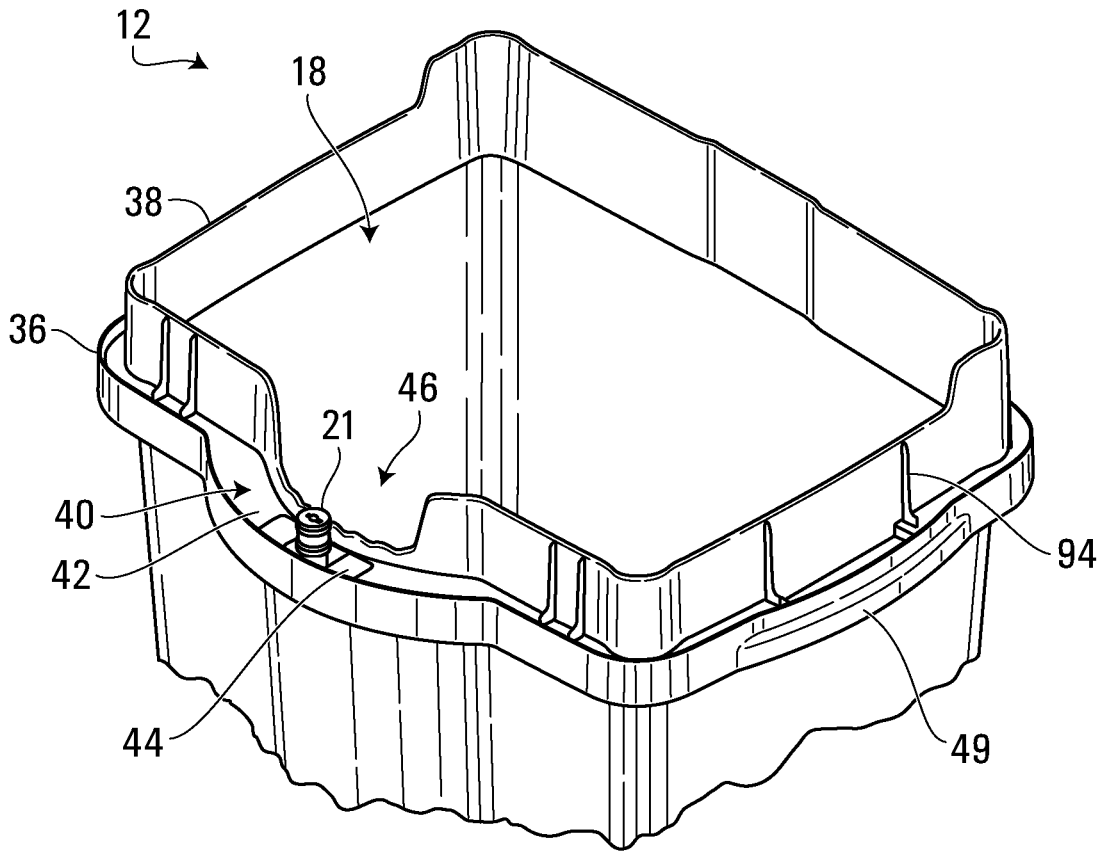
FIG. 5 is a front perspective view of a portion of the container body of the container of FIG. 1.
Figure 6:
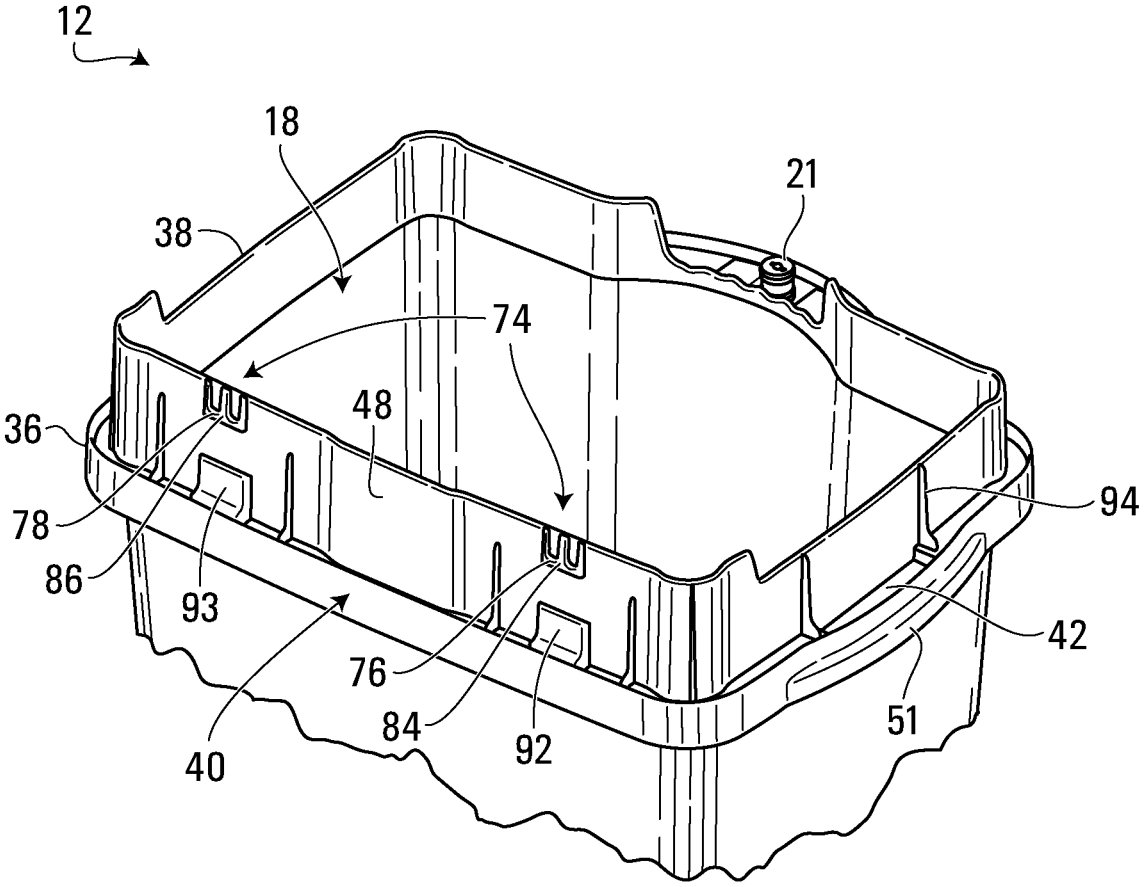
FIG. 6 is a rear perspective view of a portion of the container body of the container of FIG. 1.

As best seen in FIGS. 5 and 6, at its top, the container body 12 includes an exterior rim 36 spaced outwardly from an interior rim 38. Both the exterior rim 36 and the interior rim 38 extend substantially parallel to each other around the perimeter of the container body opening 18. A channel 40 is defined between the exterior and interior rims 36, 38 with a channel floor 42 being formed by a portion of the container body 12 that extends laterally outward from the interior rim 38. In other embodiments, either or both of the interior and exterior rims 36, 38 may extend around only one or more portions of the perimeter of the container body opening 18.

Figure 2:
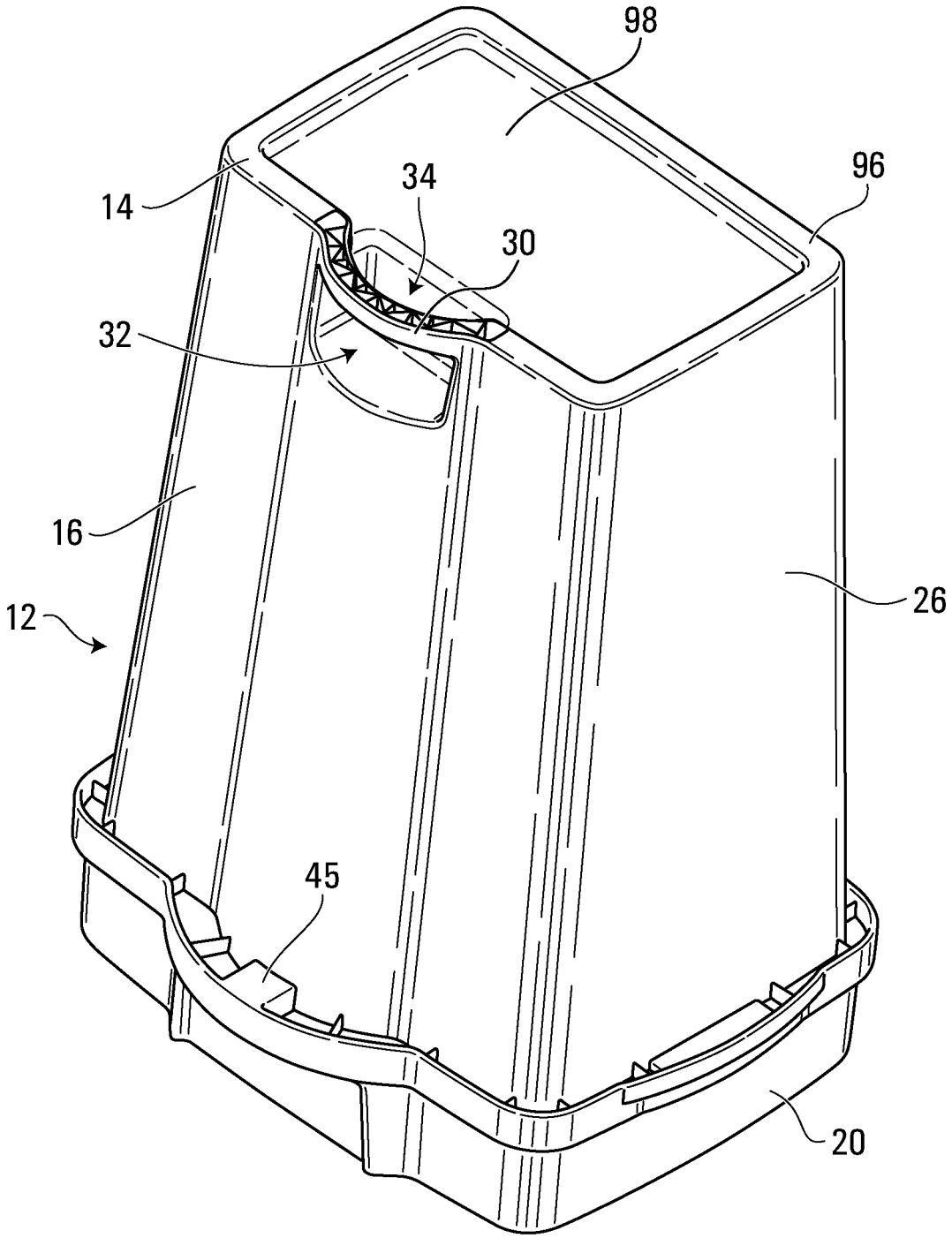
FIG. 2 is a bottom perspective view of the container of FIG. 1.
Figure 3:
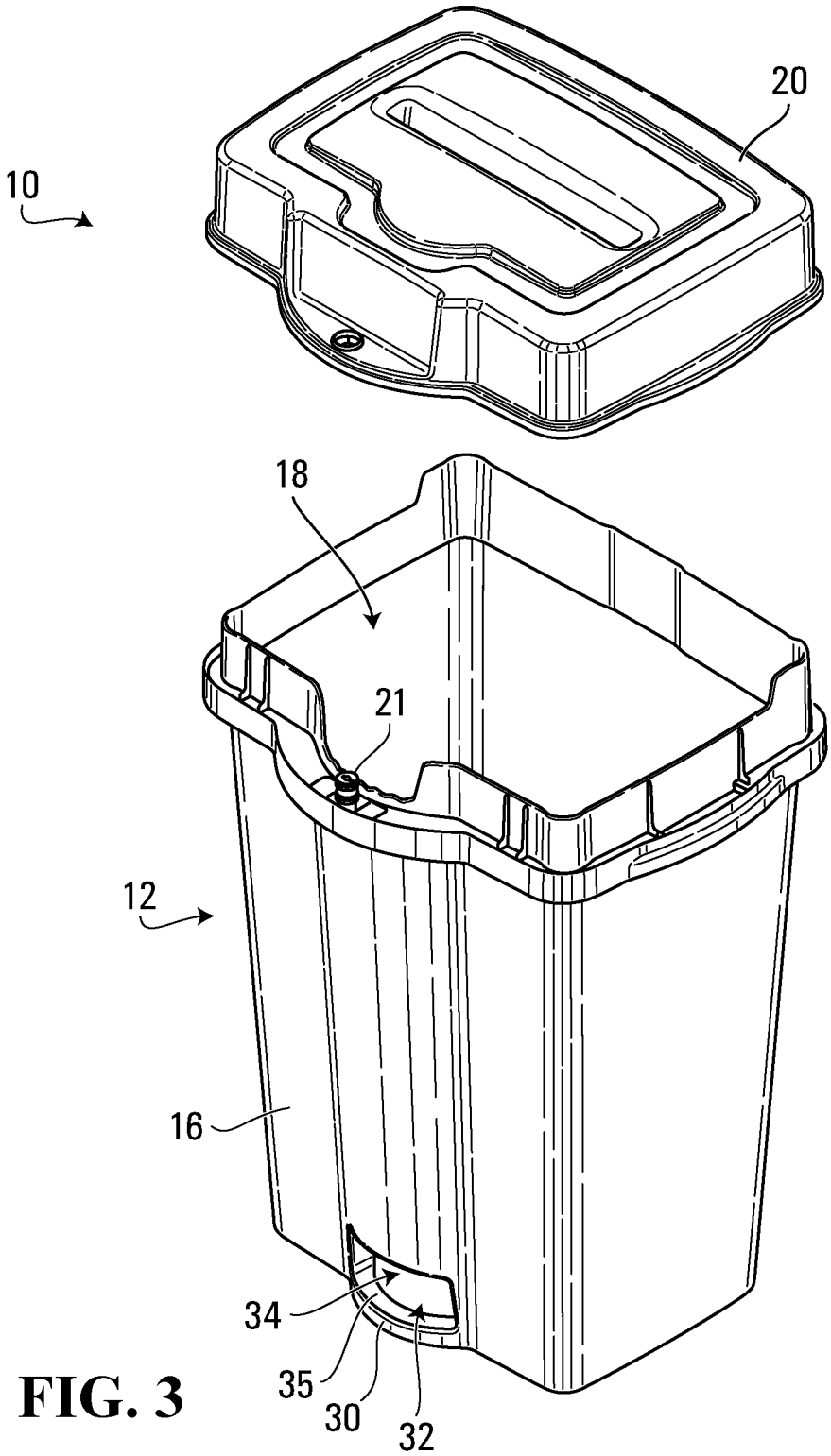
FIG. 3 is a front perspective view of the container of FIG. 1 with the lid in an exploded position.
Figure 4:
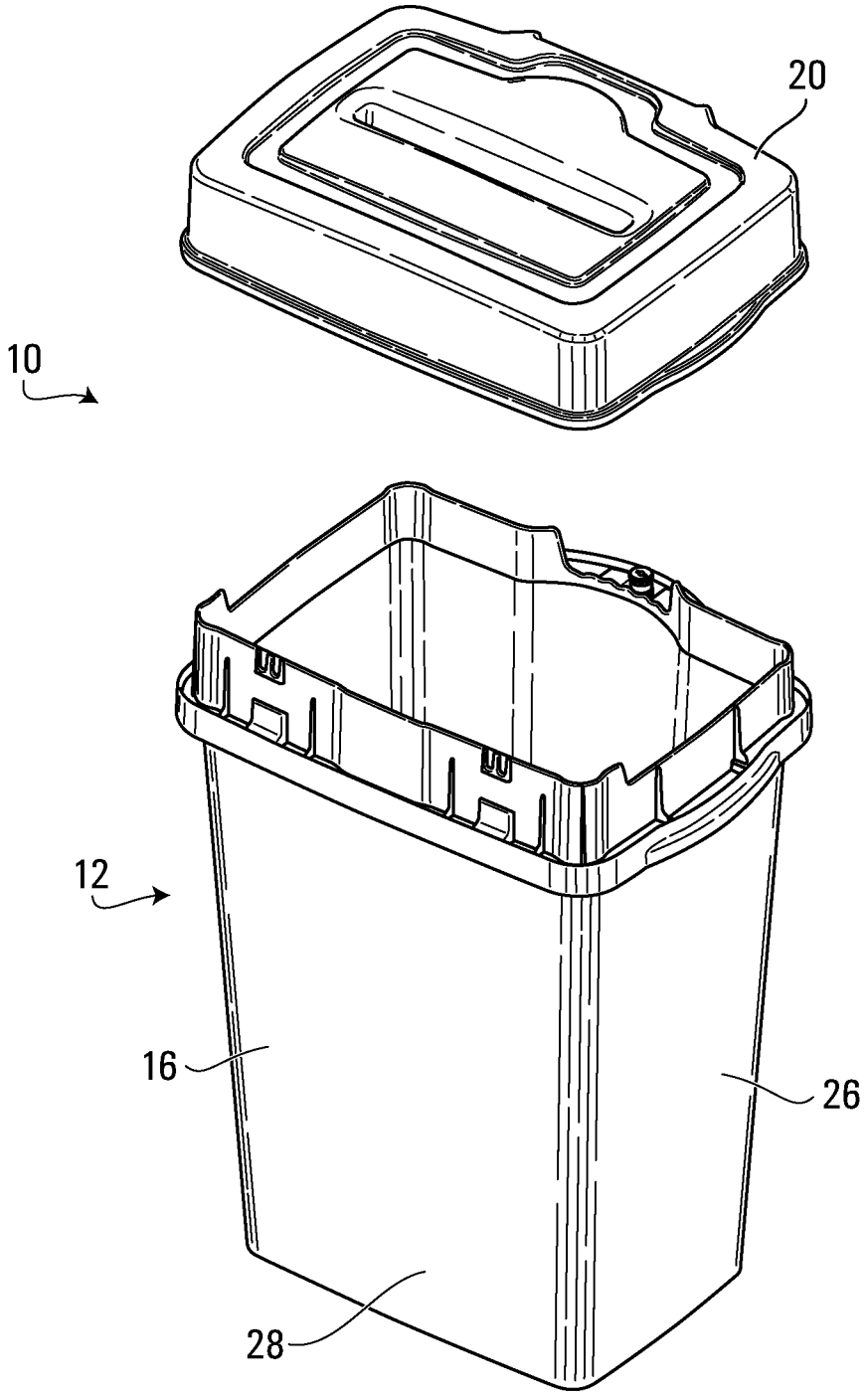
FIG. 4 is a rear perspective view of the container of FIG. 1 with the lid in an exploded position.

When locked, the lock 21 is positioned at the front side 22 of the container body 12, extending through an aperture (not visible) in the channel floor 42 and being held in place with lock plate 44, which is fixed (e.g. riveted) into the channel floor 42. The lock 21 may be configured as a type of slam lock that engages upon closing of the lid 20 and pressing the latch through the aperture in the lock plate 44. The latch then engages on the under-side of the lock plate 44. An enclosure 45, best seen in FIG. 2, is provided underneath the lock plate 44 to prevent access to the latch.

It will be understood that the lock may be configured in other ways. In some embodiments, the lock may be provided on the container body and latch with a plate in the lid, for example. Or the lock may be a combination or pad lock that passes through apertures in both the lid and container body.

A cutout 46 in the interior rim 38 is provided at the front side 22 adjacent the lock 21 and vertically aligned with the handle 30. An edge of the interior rim 38 in the cutout 46 is wave-like to provide a grip for a user emptying the container. For example, the user may place one hand in the cutout 46 and hold the handle 30 with the other hand to tip the container backwards and pour out its contents.

In the illustrated embodiment, the interior rim 38 extends upwards more than the exterior rim 36 and includes a raised rear portion 48 that extends along the rear side 28 and portions of the left and right sides 24, 26. The raised portion 48 may aid in guiding paper out of the container body 12 as it is being emptied.

Exterior rim 36 also includes side handles 49 and 51 to aid in lifting the container 10. In the illustrated embodiment, the handles 49, 51 are moulded as part of the exterior rim 36 and are configured as outcroppings of the exterior rim 36 that extend laterally outward from the side wall 16. However, in other embodiments they may be separate components affixed to the container body 12. In yet other embodiments, the handles 49, 51 may be omitted entirely.

Figure 7:
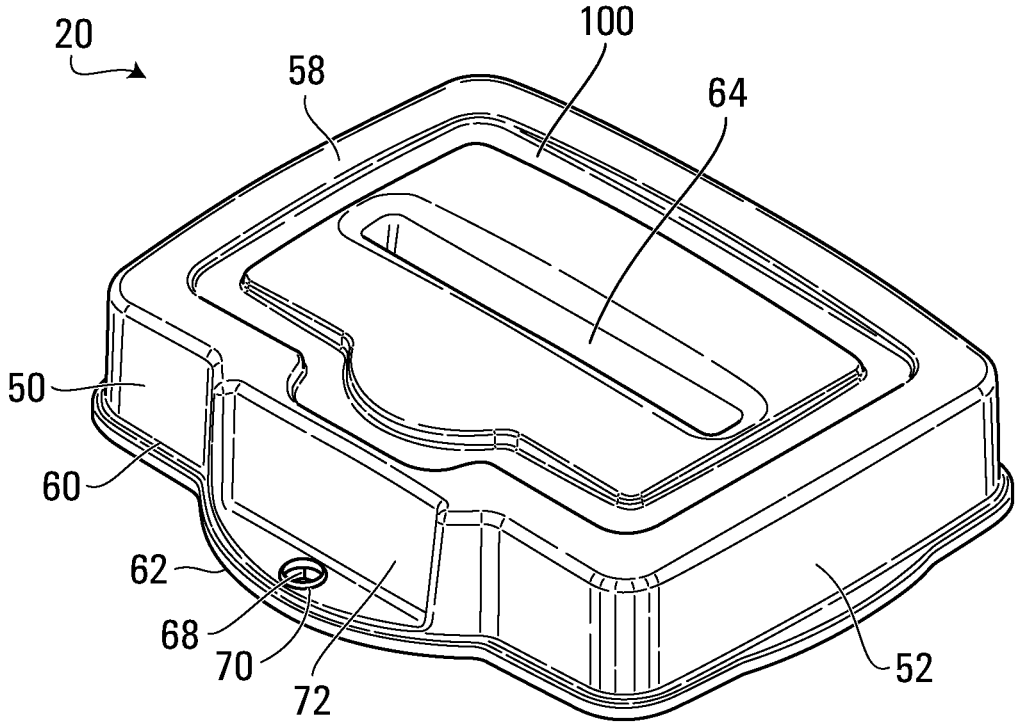
FIG. 7 is a top perspective view of the lid of the container of FIG. 1.
Figure 8:
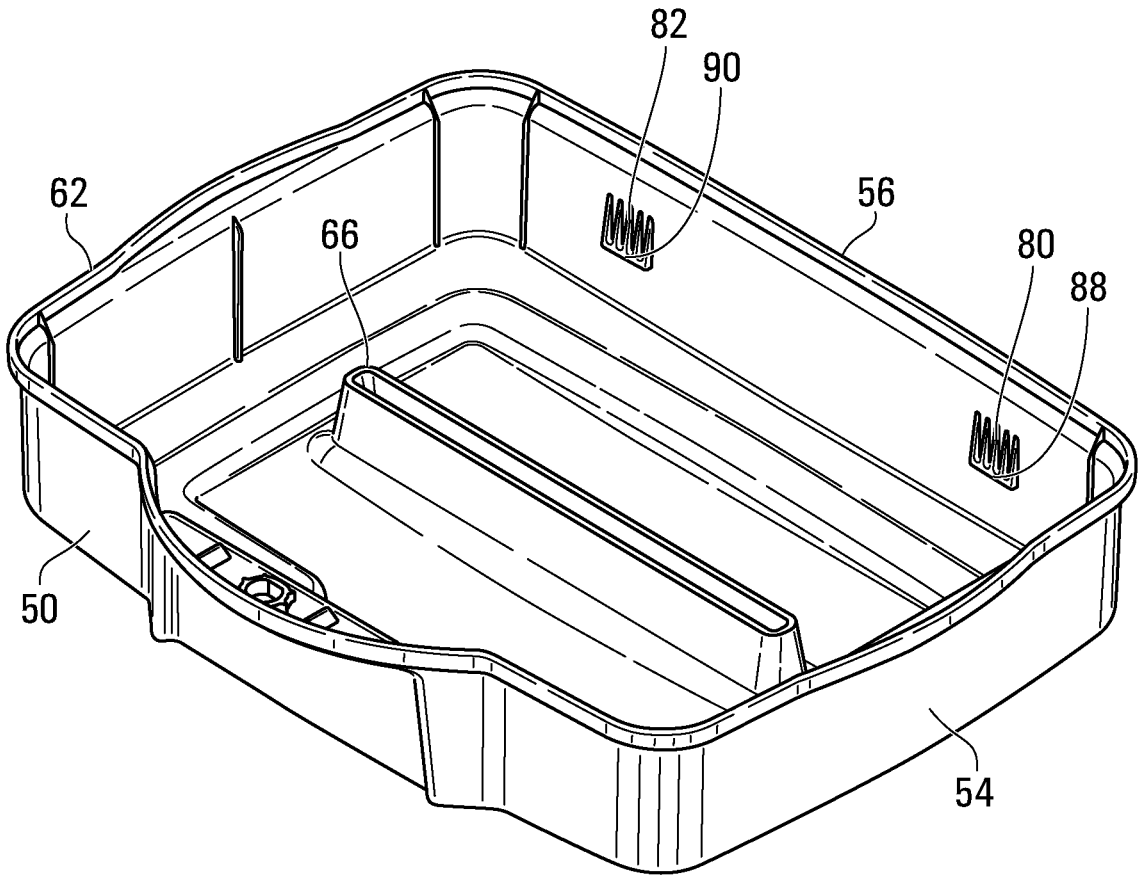
FIG. 8 is a bottom perspective view of the lid of the container of FIG. 1.
Figure 9:
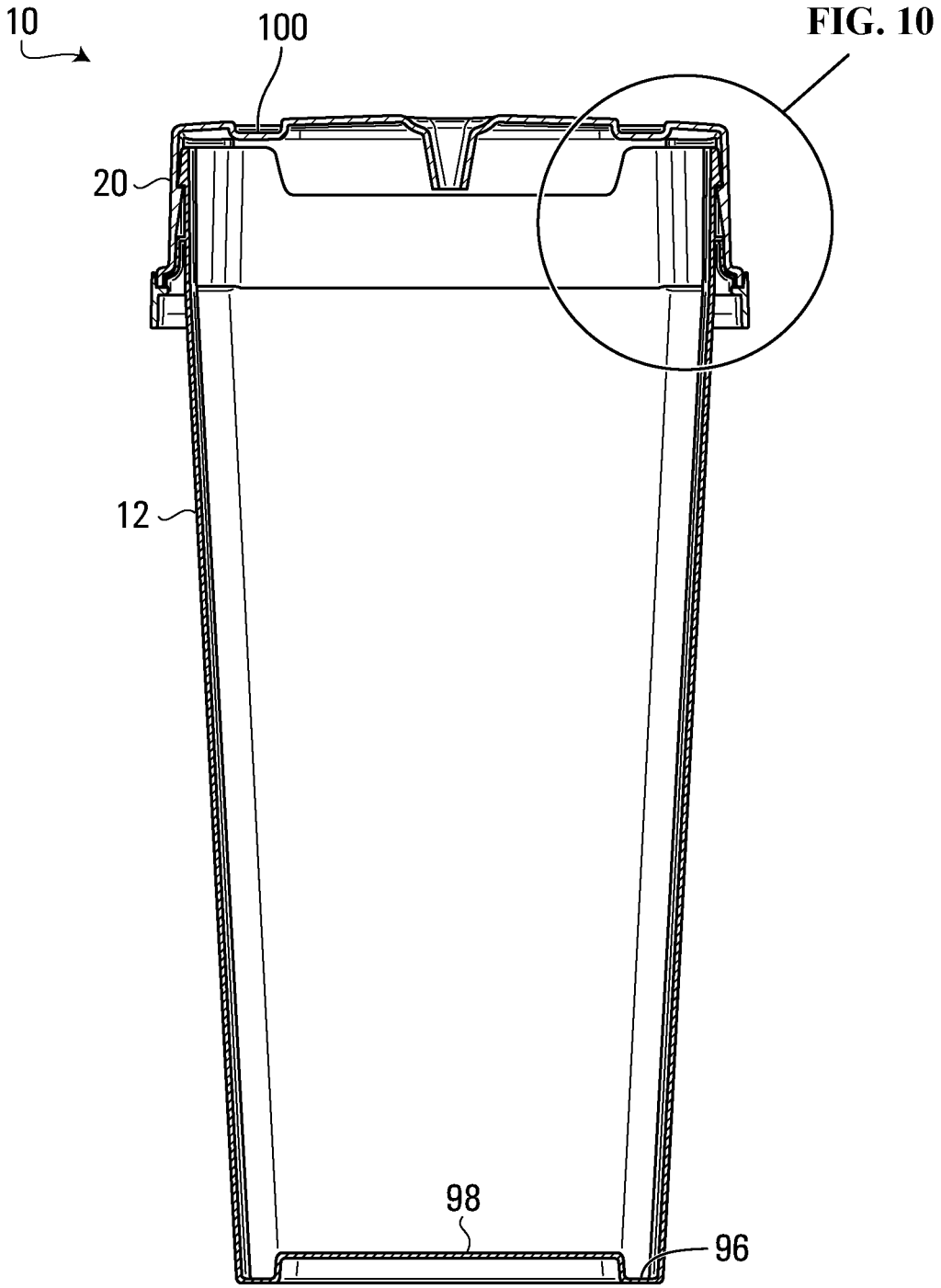
FIG. 9 is a cross-sectional view taken along line 9-9 in FIG. 1.

Referring to FIGS. 7 and 8, the lid 20 has a shape that generally corresponds and is complementary to the shape of the opening 18 with a front side 50, a right side 52, a left side 54, a rear side 56 and a top 58. A rim 60 extends around a perimeter of the lid 20 and includes a downwards extending lip 62.

The container 10 includes an opening for placing items into the container when the lid 20 covers the container 10. In the illustrated embodiment, the opening is arranged in the lid 20 and is configured as an elongated slot 64. On an underside of the lid 20, a guard 66 extends around the slot 64 and into the interior of the container 10. The guard 66 may be tapered. The guard 66 permits items, such as paper, to be inserted but helps prevent unauthorized removal of contents of the container 10. In other embodiments, the opening may be arranged elsewhere, for example in the side wall 16.

At the front of the lid 20, a key hole 68 is provided that receives the cylinder of lock 21. The key hole 68 is circumscribed by lip 70, which aids in preventing tampering of the lock by wedging a tool, such as a flat head screw driver, under the lock cylinder.

A flat display area 72 is also provided on the front side 50 to allow for labelling or other information. It will be understood that the display area 72 may be omitted or configured differently.

Since containers have lids that are removable, i.e. separable from the container body, when a lid is locked to its container body, the resilient nature of the plastic material from which such containers are produced, might allow someone seeking unauthorized access to the container to pry the lid from the container body. The side of the container opposite the side on which the lock is provided might be the least secure location.

Thus, referring to FIGS. 6 to 10, embodiments of a container according to the present disclosure include an engagement structure 74 arranged on the container body 12. In the illustrated embodiment, the engagement structure 74 is arranged on the rear side 28 opposite the lock 21. However, in other embodiments, the engagement structure 74 is not necessarily arranged opposite of the lock and may be arranged on a side perpendicular to the side of the lock or on the same side of the lock. In embodiments where the container body has an oval or round shape, the engagement structure 74 may be spaced from the lock along a distance on the circumference. The engagement structure 74 is configured to cooperate with the lid 20 to resist or prevent separation of the lid 20 from the container body 12 when the container 10 is locked.

In the illustrated embodiment, the engagement structure 74 includes two protrusions 76 and 78 spaced from each and arranged adjacent the top of the raised rear portion 48. The protrusions 76, 78 are configured as tabs that extend out laterally from the interior rim 38 and are elongated in a direction substantially parallel to the rear side 28.

In the illustrated embodiment, the protrusions 76, 78 are shown with two small depressions. These are included to create central ribs which provide additional structural integrity to the protrusions 76, 78.

As best seen in FIG. 8, the lid 20 has, on the interior of the lid rear side 56, protrusions 80, 82 that are configured to cooperate with protrusions 76, 78 to resist separation of the lid 20 from the container body 12. In the illustrated embodiment, the protrusions 80, 82 are also configured to include ribs for additional structural integrity.

The protrusions 76, 78, 80, 82 are configured as ramps that extend downward (in the case of protrusions 76, 78) and upward (in the case of protrusions 80, 82). Protrusions 76 and 78 terminate at surfaces 84 and 86, respectively, which, in the illustrated embodiment, are risers of the ramp. Protrusions 80 and 82 terminate in surfaces 88 and 90, respectively, which, in the illustrated embodiment, are risers of the ramp.

Figure 10:
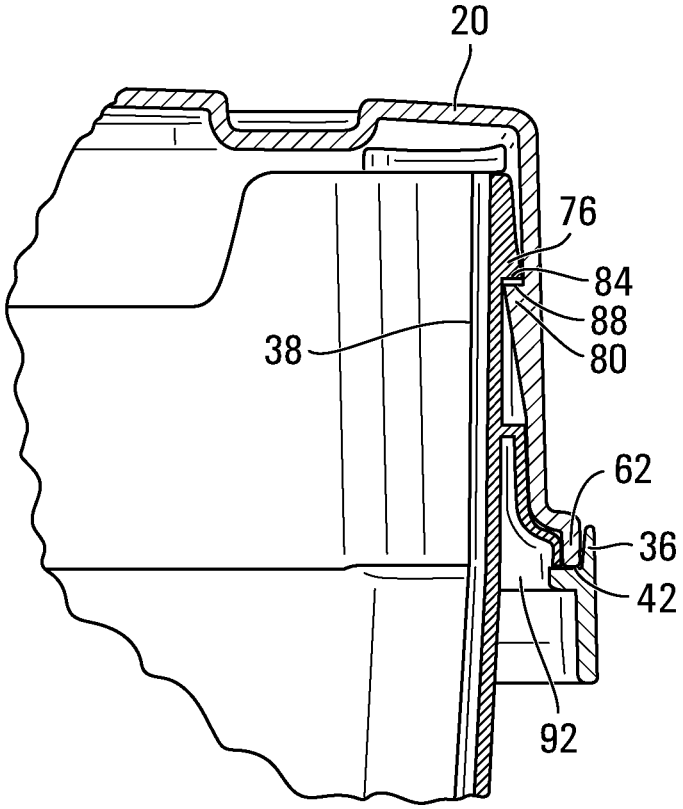
FIG. 10 is an enlarged fragmentary view of the portion indicated in FIG. 9.

Surfaces 84, 86 act as interference surfaces that interfere with surfaces 88, 90, respectively, when a user attempts to remove the lid 20 from the container body 12 when the container 10 is locked. For example, as seen in FIG. 10, surface 84 of protrusion 76 is arranged substantially horizontally and parallel to surface 88 of protrusion 80. Because of clearances and the fact that the container 10 is locked using lock 21, an attempt to separate the lid 20 from the container body 12 would cause the surfaces 84, 88 to contact and resist the separation. Similarly, surfaces 86 and 90 would contact and resist separation.

Furthermore, the lip 62 is received in the channel 40 adjacent the engagement structures between the interior and exterior rimes 38, 36. The exterior rim 36 extends upwards along the lip 62. This may aid in preventing unauthorized access by someone attempting to use a tool, such as a flat head screw driver, to wedge the lip 62, and thus the rim 60, away from the interior rim 38 and clear the engagement structures in order to lift the rear of the lid 20.

Moreover, in the illustrated embodiment, stop protrusions 92, 93 are provided on the interior rim 38 below each of the protrusions 76, 78, respectively. The stop protrusions 92, 93 have a shape that is complementary to the rim 60 of the lid 20 and lip 62 such that, when the lip 62 is received in the channel 40, it is sandwiched between the stop protrusions 92, 93 and the exterior rim 36. This may further aid in preventing someone from being able to bend the lip 62 towards the interior rim 38 and defeat the engagement structure 74. Stop protrusions 92, 93 may also lend structural support to the interior rim 38.

Similarly, one or more ribs 94 are provided spaced along the interior rim 38. In addition to providing structural support to the interior rim 38, the ribs 94 further aid in preventing the lid 20 and lip 62 from being bent towards the interior rim 38 when the lid 20 is in the closed position.

When the container is unlocked, the lid 20 may be removed by rotating the lid 20 from the closed position around an axis generally parallel to the rear side 28. Thus, to open the container 10, a user would lift the lid 20 on the front side 50, causing the lid 20 to rotate, until the lid protrusions 80, 82 sufficiently clear protrusions 76, 78. The lid 20 could then be removed from the container body 12. In the illustrated embodiment, the amount of rotation needed to disengage the engagement structure 74 is approximately 10 degrees but other configurations are possible.

In order to enable a one-handed unlocking operation, as noted above, a user may place a foot on handle 30 and into recess 32 to push down and keep the container body 12 on the ground while the lid 20 is unlocked and lifted. In this manner, handle 30 may also act as a foothold for a user's foot.

Other embodiments of the engagement feature may also be possible. For example, there may be only a single protrusion, such as a single ramp, on either of the lid and container body. In some embodiments, the engagement feature may include differently shaped protrusions, complementarily shaped protrusions, or protrusion and aperture combinations. The engagement structure may be configured in a variety of ways to achieve an interference between the lid and container body to aid in preventing separation of the lid from the container body when the lid is locked.

As noted above, in some embodiments, it may be desirable to be able to stack the containers, for example to permit easy transport of multiple containers on a dolly. Accordingly, some embodiments according to the present disclosure include complementary male and female structures on the lid and the bottom of the container that permit the bottom of an identical second container to be stacked on the lid.

Such male and female structures could include one or more protrusions on one of the lid and the bottom and a corresponding number of complementary depressions on the other of the lid and the bottom, each depression having a shape complementary to a shape of a respective one of the one or more protrusions.

For example, referring again to FIGS. 1, 2 and 9, the bottom of the container 10 includes a protruding portion 96 that extends around the perimeter of the bottom 14. The protruding portion 96 is defined by an interior raised floor 98 of the bottom 14. A corresponding depression 100 is arranged on the lid 20 and has a shape complementary to the shape of the protruding portion 96 and the handle 30, since the handle 30 also forms part of the footprint of the container body 12. Specifically, in the illustrated embodiment, the depression 100 is configured as a channel with a cross-section complementary to a cross-section of the protruding portion 96. The depression extends in a loop around the opening 64.

When a second, identical container 10 is stacked on the lid 20, the depression 100 receives the protruding portion 96, providing stability to the stack. The male and female structures may also act as locating features, allowing the containers to slide into place. Rounded edges on both the protruding portion 96 and depression 100 may aid such a locating function.

It may be desirable to form the protruding portion 96 as part of the perimeter of the bottom 14 as this provides the widest base for the second container to stand on when stacked, aiding stabilization of the stack.

In other embodiments, the complementary male and female structures may be configured differently. For example, there may be one or more individual protruding portions and/or depressions on the lid and complementary protruding portions and/or depressions on the bottom. There may be a single depression on the lid that matches the footprint of the bottom, without the depression being a channel and without a separate protruding portion on the bottom. It will also be understood that modifications to the illustrated embodiment, such as omission of the handle 30, may result in a modification of the depression 100 to accommodate a different shape of the bottom 14. All such alternative embodiments and modifications are within the scope of the present disclosure.

The illustrated embodiment of the container may be moulded, such as injection, rotation or structural foam moulded. In that case, some or all of the above-discussed features, may be moulded integrally with the container body and/or the lid. However, in some embodiments one or more of the above-described features, such as the handle, the engagement structure, corresponding features on the lid and the male and female stacking structures, may be separate components that are fixed to the lid and/or the container body.

Moreover, while different aspects of the container have been described with reference to a single illustrated embodiment, it should be understood that some or all of the features may be present independently of each other. Thus, embodiments according to the present disclosure may include a handle, such as the handle 30, without including an engagement structure. Conversely, embodiments according to the present disclosure may include an engagement structure to aid in securing the lid but not have the handle. Similarly, the male and female structures for stacking the container may be present without the handle and/or the engagement structure.

What has been described is merely illustrative of the application of principles of embodiments of the present disclosure. Other embodiments are also within the present disclosure, such as any and all methods related to the manufacture, provision, use and operation of the embodiments of the container.

The invention claimed is:

1. A lockable container with an opening for receiving paper for later disposal, the lockable container comprising:

a container body having a bottom and a side wall extending upwards from the bottom, the side wall defining a container body opening;

a removable lid to cover the container body opening; and a lock for locking the lid to the container body, the lock positioned at a front side of the container body, wherein one or more container protrusions, which are separate from the lock, are arranged on a container rear side of the container body and interfere with one or more lid protrusions on the lid to resist separation of the lid from the container body when the lid is locked to the container, wherein the one or more lid protrusions on the lid are positioned on an interior of a lid rear side of the lid.

2. The lockable container of claim 1, wherein the one or more container protrusions comprise one or more interference surfaces configured and arranged to interfere with a corresponding number of surfaces arranged on the one or more lid protrusions.

3. The lockable container of claim 1, wherein the one or more lid protrusions and container body are configured to positively interfere with each other to resist separation of the lid.

4. The lockable container of claim 1, wherein the one or more container protrusions include a container body protrusion with a first engagement surface arranged on the container body, wherein the one or more lid protrusions include a particular lid protrusion with a second engagement surface arranged on the lid, wherein, when the lid is in a closed position on the container body, the first engagement surface and the second engagement surface are positioned substantially horizontally and substantially parallel to each other.

5. The lockable container of claim 4, wherein the particular lid protrusion and the container body protrusion are both configured as tabs or ramps extending from the lid and container body, respectively.

6. The lockable container of claim 1, wherein the container body includes a channel that extends around at least a portion of a perimeter of the container body opening and wherein, when the lid is in a closed position on the container body, at least a portion of the lid adjacent the one or more container protrusions is received in the channel of the container body.

7. The lockable container of claim 6, wherein the channel is formed between an outer rim of the container body and an inner rim of the container body.

8. The lockable container of claim 7, wherein the container body includes a stop protrusion arranged proximate the one or more container protrusions, wherein at least a portion of the lid adjacent the one or more container protrusions is received between the stop protrusion and the outer rim.

9. The lockable container of claim 8, wherein a respective stop protrusion is arranged below each of the one or more container protrusions.

10. The lockable container of claim 7, wherein the container body includes one or more ribs arranged on the inner rim of the container body extending into the channel and configured to resist flexing of a lid rim of the lid towards the container body.

11. The lockable container of claim 1, wherein the one or more lid protrusions and the one or more container protrusions are configured to permit removal of the lid from the container body by rotating the lid upward from the lock when the container is unlocked.

12. The lockable container of claim 1, wherein the one or more container protrusions are arranged on a side of the container body opposite the lock.

13. A stackable and lockable container with an opening for receiving paper for later disposal, the stackable and lockable container comprising:

a container body having a bottom and a side wall extending upward from the bottom, the side wall defining a container body opening;

a lid to cover the container body opening; and a lock for locking the lid to the container body, wherein the bottom comprises a protruding portion that is complementary to a depression in the lid to permit the bottom of an identical second container to be stacked on the lid, wherein the depression extends in a loop.

14. The stackable and lockable container of claim 13, wherein the depression in the lid is a channel with a first cross-section complementary to a second cross-section of the protruding portion.

15. The stackable and lockable container of claim 13, wherein the protruding portion extends around at least a portion of a perimeter of the bottom.

16. The stackable and lockable container of claim 15, wherein the depression is a channel with a first cross-section complementary to a second cross-section of the protruding portion.

* * * * *